US008920256B1

(12) United States Patent
Ffitch

(10) Patent No.: US 8,920,256 B1
(45) Date of Patent: Dec. 30, 2014

(54) GOLF CLUB SWING TRAINING DEVICE

(71) Applicant: George Ffitch, Victoria (CA)

(72) Inventor: George Ffitch, Victoria (CA)

( * ) Notice: Subject to any disclaimer, the term of this patent is extended or adjusted under 35 U.S.C. 154(b) by 125 days.

(21) Appl. No.: 13/758,316

(22) Filed: Feb. 4, 2013

(51) Int. Cl.
*A63B 69/36* (2006.01)

(52) U.S. Cl.
CPC ..... *A63B 69/3623* (2013.01)
USPC ..... 473/226; 473/219; 473/294; 473/295; 473/296

(58) Field of Classification Search
USPC ..... 473/219, 226, 256, 294, 295, 296, 298
See application file for complete search history.

(56) References Cited

U.S. PATENT DOCUMENTS

| | | | | |
|---|---|---|---|---|
| 5,330,190 | A * | 7/1994 | Oakley, Jr. | 473/234 |
| 5,452,891 | A * | 9/1995 | Thomas | 473/294 |
| 6,503,149 | B2 * | 1/2003 | Jelinek | 473/224 |
| 6,776,724 | B1 * | 8/2004 | Siemsglusz | 473/294 |
| 6,817,956 | B1 * | 11/2004 | Dagenais | 473/300 |
| 6,955,610 | B1 * | 10/2005 | Czaja et al. | 473/256 |
| 6,966,844 | B2 * | 11/2005 | Welles | 473/224 |
| 7,150,685 | B1 * | 12/2006 | Berokoff | 473/294 |
| 7,618,328 | B2 * | 11/2009 | Davenport et al. | 473/257 |
| 8,105,179 | B1 * | 1/2012 | Allen | 473/294 |
| 2006/0142091 | A1 * | 6/2006 | Berokoff | 473/204 |
| 2007/0197310 | A1 * | 8/2007 | Lusky | 473/294 |
| 2007/0238544 | A1 * | 10/2007 | Jazwiec | 473/294 |
| 2010/0105495 | A1 * | 4/2010 | Libonati | 473/224 |
| 2012/0283034 | A1 * | 11/2012 | Morton | 473/292 |

* cited by examiner

*Primary Examiner* — Raleigh W Chiu
(74) *Attorney, Agent, or Firm* — Harpman & Harpman

(57) ABSTRACT

A golf club shaft swing training and practice device to impart axial rotation to the user's hand during the length of the stroke by utilizing a fixed upper handgrip and a movable lower handgrip on a support rod. The upper handgrip is fixed on the rod and the lower handgrip is slidably disposed along the rod which is cross-sectionally square with a longitudinal spiral twisted surface to impart lower grip axial rotation as it is moved therealong in increasing distance from the fixed upper handgrip during a practice swing.

14 Claims, 5 Drawing Sheets

GOLF CLUB SWING TRAINING DEVICE

BACKGROUND OF THE INVENTION

1. Technical Field

This invention relates to the game of golf and specifically golf club swing training oriented devices that through repetitive use instill preferred user actions and therefore improved performance. One key element in a preferred golf swing is the effective axial rotation of the club shaft to present a square or squaring club face at the point of impact with the golf ball. Therefore correct directional shaft rotation by applied unified hand action through accurate projection is critical.

2. Description of Prior Art

Prior art devices of this type have been directed to a variety of different golf club hand grips that permit rotation of the lower hand during a golf swing, see for example U.S. Pat. Nos. 3,806,130, 3,834,714, 5,413,339, 5,538,476 and U.S. Publication 2001/0041626 A1.

U.S. Pat. No. 3,806,130 is directed to golf club grip and training aid for teaching the proper grip in the golf swing. A tapered sleeve is provided that fits over the handle of a conventional golf club grip to prevent the forward hand from gripping the club too tightly. The thumb of the rearward hand obstructs and detects rotavie movement of the sleeve during the execution of a golf club swing.

U.S. Pat. No. 3,834,714 claims a practice golf club by dividing the club grip into two parts. The upper portion is fixed with the lower portion being freely rotatable on a sleeve with an intermediate coil spring for imparting rotational tension thereto.

U.S. Pat. No. 5,413,339 describes rotating golf club handle that provides for a handle sleeve mounted on the shaft adjacent the club handle allowing for hand rotation thereon.

Ser. No. 5,538,476 illustrates a golf club shaft to allow axial rotation in adapted relation between the golf club head and upper grip portion utilizing an intermediate internal shaft cylindrical components therewith.

Finally, in U.S. Publication 2001/0041626 which defines a rotatable grip assembly for golf clubs having a cylindrical configuration for receiving a golf club head at its lower extent and the grip at its upper extent.

SUMMARY OF THE INVENTION

A golf swing training device having a pair of hand grips, one fixed and one slidably disposed on elongated twisted activation rod extending from the first hand grip to a practice ball representation secured on its free end. The movable hand grip is keyed to the twisted activation rod and will rotate on its axis as moved therealong imparting a rotation of the golfer's hand thereon. This repetitive rotational disparity between the respective handgrips impart the correct hand action to the golf club orientation emulating the proper club head face "squared" to the ball during contact of a traditional golf club swing.

DETAILED DESCRIPTION OF THE INVENTION

Figure 1:
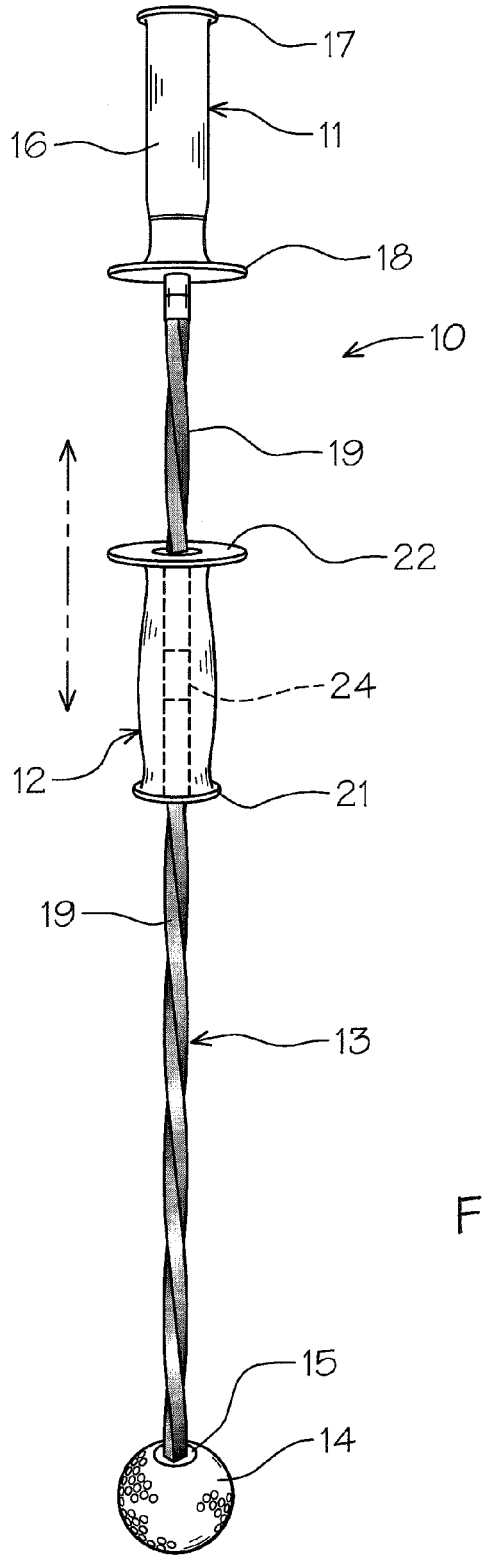
FIG. 1 is a front perspective view of the golf swing training device with the hand grips separated as during use.

Referring now to FIG. 1 of the drawings, the golf club swing trainer 10 of the invention can be seen having a pair of golf club handgrips 11 and 12 on an activation rod 13 with a golf ball representation 14 on its oppositely disposed free end at 15. The upper handgrip 11 is affixed to the end of actuation rod 13 and has an elongated cylindrical body member 16 with an annular end flange 17 and oppositely disposed enlarged annular handle flange 18 thereon.

The activation rod 13 is cross-sectionally square with an extended elongated surface twist 19 therein which extends from the fixed handgrip 11 annular end stop 18 to the golf ball representation which, as noted, is affixed to the end of the activation rod 13 and this example chosen for illustration is in the form of a golf ball representation as will be well known to those skilled in the art.

Figure 2:
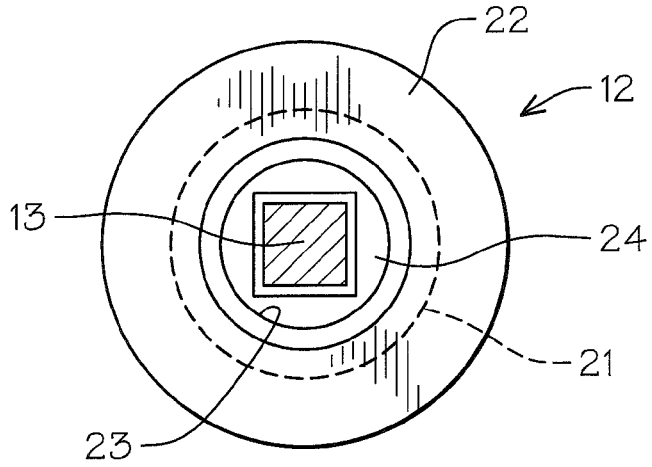
FIG. 2 is an enlarged sectional view on lines 2-2 of FIG. 6.
Figure 3:
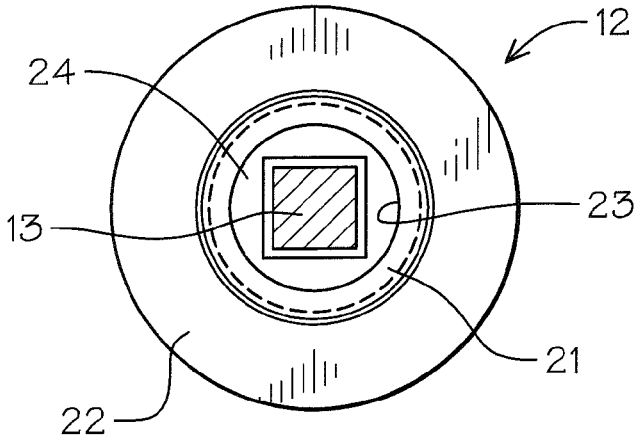
FIG. 3 is an enlarged sectional view on lines 3-3 of FIG. 6.
Figure 6:
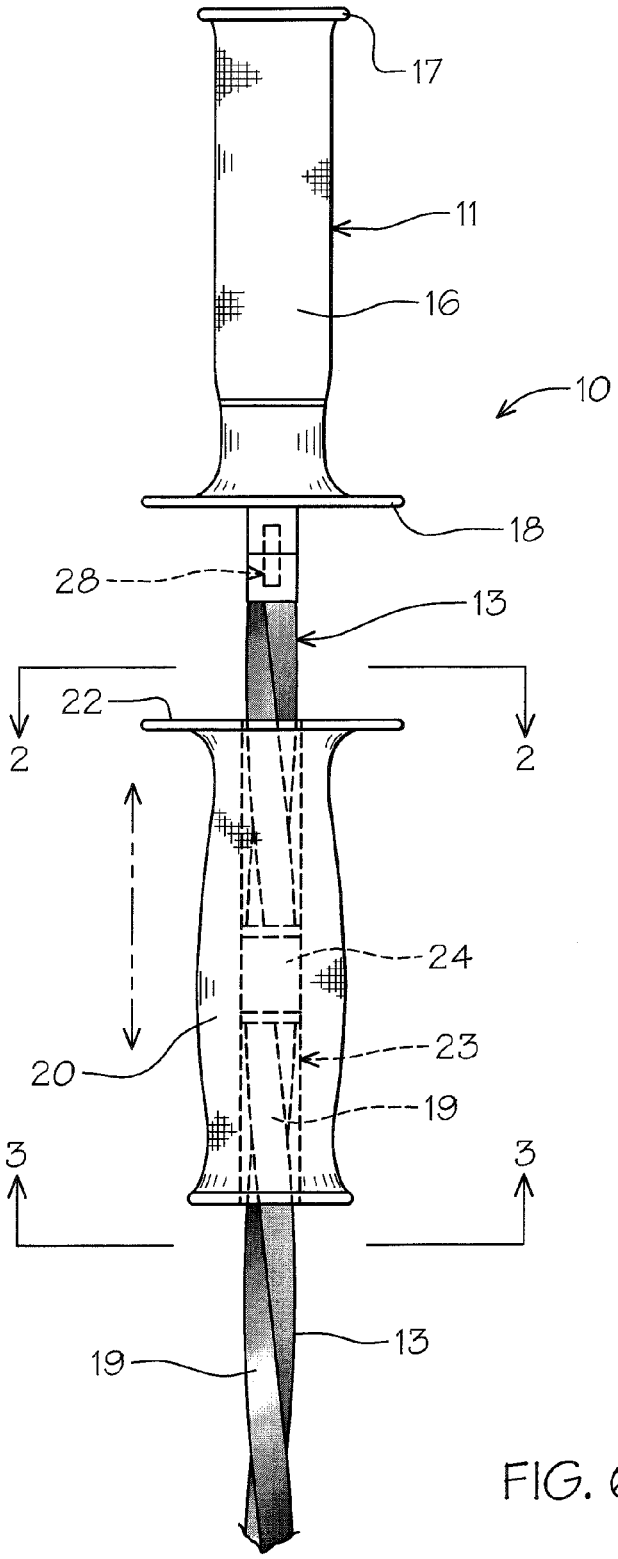
FIG. 6 is an enlarged partial front elevational view illustrating the upper hand grip affixed to the shaft and the lower hand grip movable thereon.
Figure 7:
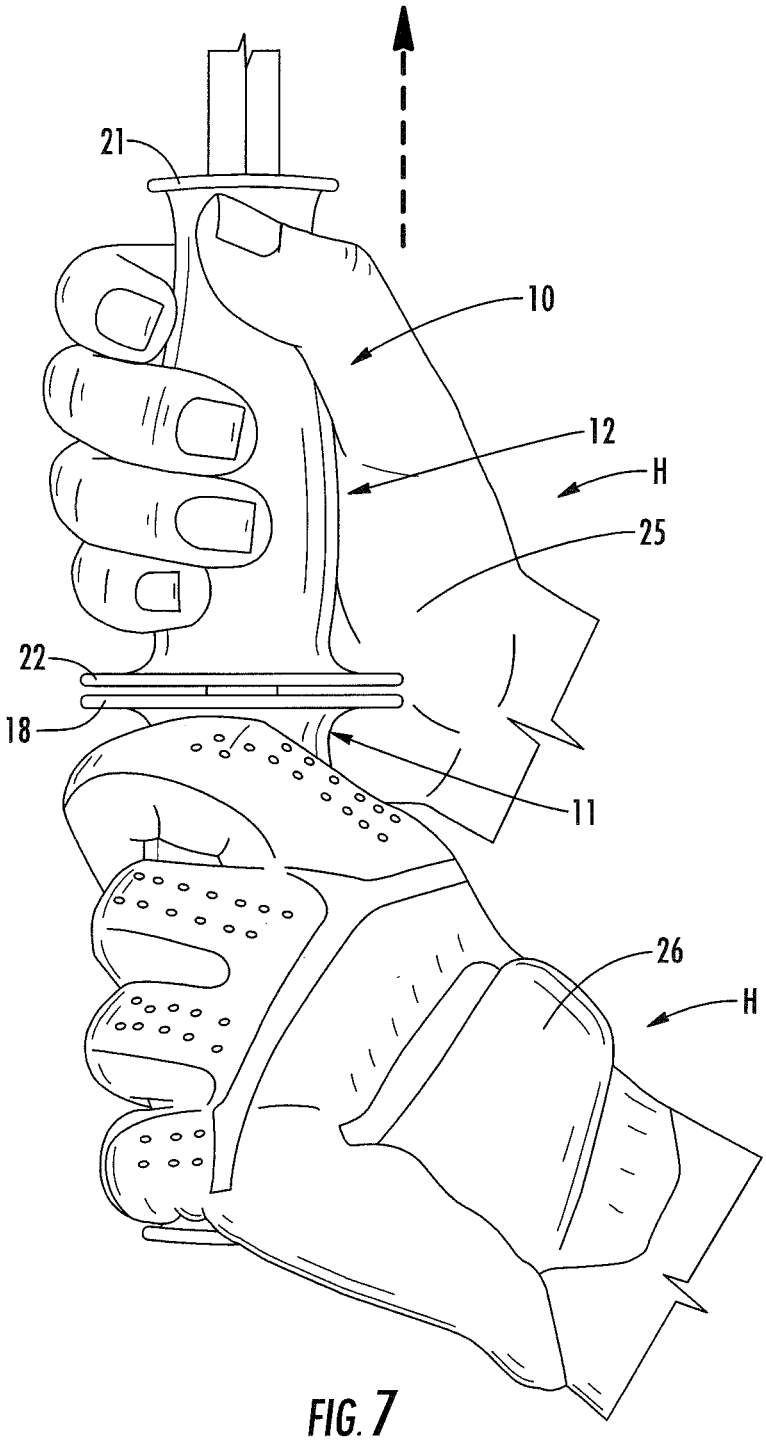
FIG. 7 is an enlarged partial perspective view of a golfer's hands gripping the hand grips of the device.

The lower movable handgrip 12 is slidably positioned on the activation rod 13 and is of a length, diameter and overall dimension similar to that of the upper fixed handgrip 11. The movable lower handgrip 12 has therefore a main cylindrical body member 20 with corresponding end flange 21 and spaced oppositely disposed enlarged annular handle end flange 22 which will be selectively engaged against the hereinbefore described handle end flange 18 of the upper first handgrip 11. As seen in FIGS. 2, 3 and 6 of the drawings, a second movable lower handgrip 12 has a central axial bore 23 extending therethrough with a cross-sectionally squared apertured key insert fitting 24 of a corresponding registerable dimension to that of the hereinbefore described surface of the activation rod 13. It will therefore be seen that as the second lower movable handgrip 12 is slid along the activation rod 13 that it will rotate on its longitudinal axis imparting such axial rotation to the user's hand 25 as seen graphically in FIG. 7 of the drawings during a practice training swing.

The golfer's hands H defined by hand 25 on the lower movable handgrip 12 and by the hand 26 on the upper fixed end handgrip 11 simulate a golfer's club grip. In the game of golf, the effective axial rotation of the golf club head through the length of the swing/stroke would be approximately ninety degrees with the club head squared at the point of impact (bottom of the swing) as opposed to the club head orientation at the "top" of the golf swing/stroke. It will therefore be seen by use of the golf club swing trainer 10 of the invention, it effectively imparts the axial rotation within the length of the training stroke as the movable handgrip 12 slides to the farthest point away from the fixed upper handgrip 11 and is returned back to the "hands together" i.e. handgrips 11 and 12 together as at the start of the swing/stroke.

Therefore, the effective rotation of the handgrip 12 imparted by the activation rod needs to be ninety degrees at least.

It will thus be seen that by utilization of golf swing training device 10 of the invention that a true and effective handgrip axial rotation is achieved imparting the required muscle memory to the user by repetitive practice swings.

It will also be evident that the specific contours of the respective handgrips 11 and 12 shown may be varied in that it is the sliding orientation of the lower handgrip 12 in relation to the fixed upper handgrip 11 imparted by the activation rod 13 that is important not necessarily the actual shape of the specific grips themselves.

Figure 5:
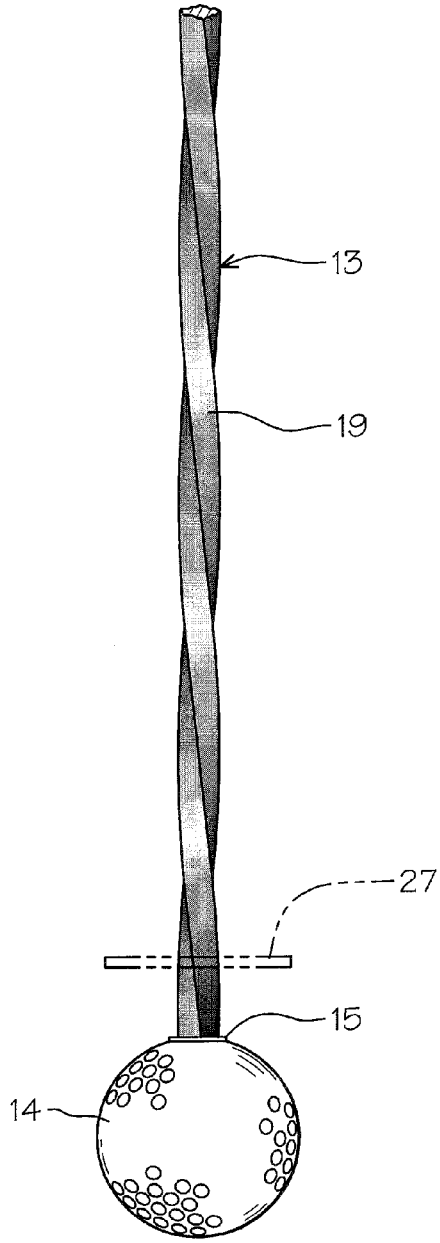
FIG. 5 is an enlarged partial front elevational view of the lower shaft and distal end and ball representation.

The terminal end golf ball representation 14 provides for a visualization element and may act additionally and optionally as a sound inducing stop for a free sliding ring 27 "tempo ring" shown in broken lines in FIG. 5 of the drawings which during use will travel freely along the activation rod 13 impacting the golf ball representation 14 at the completion of the practice swing/stroke occurs providing an accompanying audible impact representation that corresponds in stroke orientation to the effective sound that a typical golf club head would make when it impacts the ball properly at the bottom of the swing, not shown.

Figure 4:
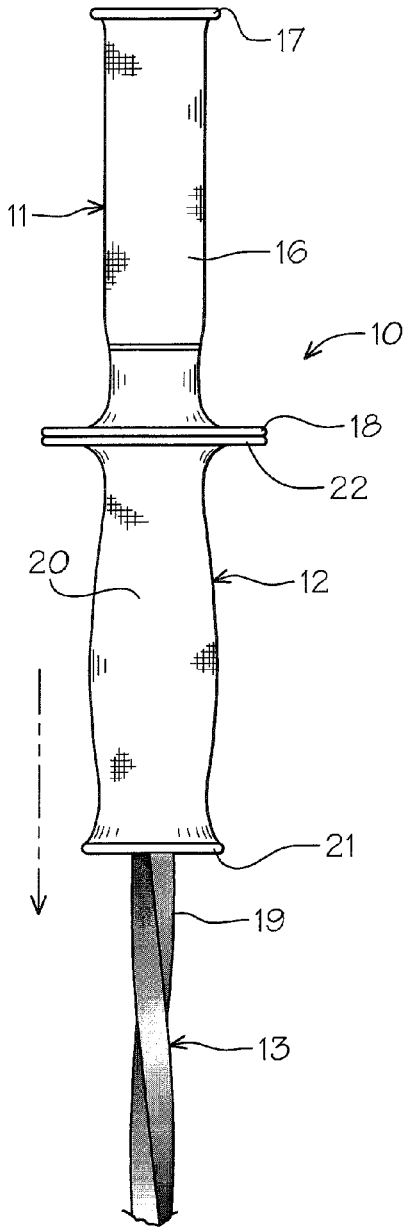
FIG. 4 is an enlarged partial front elevational view of the hand grips together at rest.

Other variations of grip orientation of the attachment to the activation rod 13 may be made, such as the angular orientation of the fixed upper grip 11 to be offset from the true longitudinal axis of the activation rod 13 may be imparted during attachment thereto as indicated by engagement fittings 28 in this example of approximately three to five percent as illustrated by the angular offset line AOL in FIG. 4 of the drawings.

These effective optional features may be introduced, but are not critical to the basic structural functionality imparted by the golf swing training device 10 of the invention in proper use configuration as illustrated and described above.

It will thus be seen that a new and novel practice golf swing trainer device 10 of the invention has been illustrated and described and it will be apparent to those skilled in the art that various changes and modifications may be made thereto without departing from the spirit of the invention.

Therefore I claim:

1. A golf swing training device comprising,
an upper end handgrip and a lower handgrip,
said upper handgrip fixed on an activation rod,
said activation rod cross-sectionally square having a spiral twisted surface,
said lower handgrip defining a central bore therethrough registerable on said contoured spiral twisted surface of said activation rod for longitudinal axial rotation therealong.

2. The golf swing training device set forth in claim 1 wherein said upper end fixed handgrip and said lower end movable handgrip have identical effacing enlarged annular handle end flanges.

3. The golf swing training device set forth in claim 1 wherein said activation rod has a ball representation on its free end.

4. The golf swing training device set forth in claim 1 wherein said upper end fixed handgrip is secured to said activation rod.

5. The golf swing training device set forth in claim 1 wherein said lower handgrip has a keyed insert secured therein registerable with said activation rod.

6. The golf swing training device set forth in claim 3 wherein said ball representation comprises a golf ball.

7. The golf swing training device set forth in claim 1 wherein said upper end and said lower end handgrips are of an equal overall length and have respective annular end edge flanges of equal diameter.

8. The golf swing training device set forth in claim 1 wherein said upper end handgrip is in longitudinal angular offset relation on said activation rod.

9. The golf swing training device set forth in claim 3 further comprises a ring movably positioned on said activation rod between said lower handgrip and said ball representation on said activation rod.

10. A golf swing training device comprising,
a first and second handgrip on a contoured activation rod,
said first handgrip is fixed, said second handgrip is registerable on and movable along said activation rod imparting axial rotation to said handgrip relative to said first handgrip,
a ball stop on the free end of said activation rod in spaced relation to said is first handgrip,
said activation rod is cross-sectionally square having a contoured spiral twisted surface.

11. The golf swing training device set forth in claim 10 wherein said first and second handgrips have identical effacing engagement annular handle end flanges.

12. The golf swing training device set forth in claim 10 wherein said first fixed handgrip has a threaded fitting extending therefrom registerable in said activation rod.

13. The golf swing training device set forth in claim 10 wherein said first and second handgrip are made of synthetic resin material.

14. The golf swing training device set forth in claim 10 wherein said second hand grip has a central bore extending therethrough and a keyed insert secured in one end thereof for registration on said activation rod.

* * * * *